US007862418B2

(12) United States Patent
Luciano, Jr. et al.

(10) Patent No.: US 7,862,418 B2
(45) Date of Patent: Jan. 4, 2011

(54) VOUCHER GAMING SYSTEMS AND METHODS

(75) Inventors: Robert A. Luciano, Jr., Reno, NV (US); Warren R. White, Reno, NV (US); Russ T. Bradford, Incline Village, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1950 days.

(21) Appl. No.: 10/301,430

(22) Filed: Nov. 20, 2002

(65) Prior Publication Data

US 2003/0092477 A1 May 15, 2003

Related U.S. Application Data

(63) Continuation-in-part of application No. 09/784,237, filed on Feb. 13, 2001, now Pat. No. 6,685,559.

(60) Provisional application No. 60/332,306, filed on Nov. 20, 2001.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/16; 463/17; 463/23; 463/25; 463/43; 273/138 A; 273/142 B; 273/139; 381/1; 381/61; 704/270; 434/185

(58) Field of Classification Search ..... 463/16, 463/17, 19, 21, 25; 430/16

See application file for complete search history.

(56) References Cited

U.S. PATENT DOCUMENTS

| | | | | |
|---|---|---|---|---|
| 2,252,733 | A | 8/1941 | Sherman et al. | |
| 2,778,424 | A | 1/1957 | Hageman et al. | |
| 2,803,304 | A | 8/1957 | Kessler | |
| 3,727,814 | A | 4/1973 | Kuckhermann | |
| 4,157,829 | A * | 6/1979 | Goldman et al. | 463/17 |
| 4,454,973 | A | 6/1984 | Irvine | |
| 4,618,085 | A | 10/1986 | Kimura et al. | |
| 4,764,666 | A * | 8/1988 | Bergeron | 463/25 |

(Continued)

FOREIGN PATENT DOCUMENTS

DE 43 44 973 A1 5/1995

(Continued)

OTHER PUBLICATIONS

U.S. Appl. No. 60/332,306, filed Nov. 20, 2001, Robert A. Luciano et al.

(Continued)

*Primary Examiner*—John M. Hotaling, II
*Assistant Examiner*—Paul A. D'Agostino
(74) *Attorney, Agent, or Firm*—David N. Caracappa; Rolando J. Tong

(57) ABSTRACT

A gaming system and related methods comprising a gaming device and a voucher mechanism in communication with the gaming device. The voucher mechanism is configured to present various types of vouchers to the player depending on a game outcome. The types of vouchers include, without limitation, a jackpot voucher, a merchandise voucher, a free play voucher, a mystery voucher, a competition entry voucher, and a restricted machine play voucher.

8 Claims, 17 Drawing Sheets

U.S. PATENT DOCUMENTS 4,865,241 A 9/1989 Hamel
4,881,839 A 11/1989 Grimm
4,946,086 A 8/1990 Suuronen et al.
5,039,242 A 8/1991 Johnson
5,076,555 A 12/1991 Bunch, Jr.
5,133,615 A 7/1992 Saito et al.
5,158,293 A 10/1992 Mullins
5,180,232 A 1/1993 Chadima, Jr. et al.
5,239,165 A * 8/1993 Novak ..... 235/375
5,249,800 A * 10/1993 Hilgendorf et al. ..... 463/27
5,265,874 A 11/1993 Dickinson et al.
5,277,424 A 1/1994 Wilms
5,290,033 A 3/1994 Bittner et al.
5,326,104 A * 7/1994 Pease et al. ..... 463/18
5,356,231 A 10/1994 Nakamura et al.
5,412,193 A 5/1995 Swartz et al.
5,495,972 A 3/1996 Nishishita et al.
5,624,066 A 4/1997 Michalovic
5,628,684 A * 5/1997 Bouedec ..... 463/17
5,687,545 A 11/1997 Baker
5,707,285 A * 1/1998 Place et al. ..... 463/12
5,713,795 A 2/1998 Kohorn
5,785,328 A 7/1998 Eckloff
5,816,918 A * 10/1998 Kelly et al. ..... 463/16
5,833,104 A 11/1998 Horniak et al.
5,919,091 A 7/1999 Bell et al.
5,928,082 A 7/1999 Clapper, Jr.
5,941,771 A 8/1999 Haste, III
5,944,606 A 8/1999 Gerow
5,949,042 A 9/1999 Dietz, II et al.
5,983,196 A 11/1999 Wendkos
6,007,426 A 12/1999 Kelly et al.
6,009,412 A 12/1999 Storey
6,012,832 A 1/2000 Saunders et al.
6,015,344 A * 1/2000 Kelly et al. ..... 463/16
6,042,285 A 3/2000 Faes et al.
6,048,269 A * 4/2000 Burns et al. ..... 463/25
6,056,289 A 5/2000 Clapper, Jr.
6,061,660 A 5/2000 Eggleston et al.
6,065,673 A 5/2000 Kokkila
6,088,222 A 7/2000 Schmitt et al.
6,110,044 A 8/2000 Stern
6,125,028 A 9/2000 Matsumoto
6,178,408 B1 1/2001 Copple et al.
6,227,972 B1 5/2001 Walker et al.
6,244,958 B1 6/2001 Acres
6,257,475 B1 7/2001 Ishii et al.
6,278,472 B1 8/2001 Sasaki et al.
6,280,326 B1 8/2001 Saunders
6,340,331 B1 1/2002 Saunders et al.
6,394,907 B1 5/2002 Rowe
6,443,642 B1 9/2002 Luciano et al.
6,840,860 B1 * 1/2005 Okuniewicz ..... 463/35
6,857,959 B1 * 2/2005 Nguyen ..... 463/25
7,008,320 B2 * 3/2006 Rowe et al. ..... 463/25
2001/0034266 A1 10/2001 Saunders
2002/0039921 A1 4/2002 Rowe et al.
2002/0077178 A1 6/2002 Oberberger et al.
2002/0098888 A1 7/2002 Rowe et al.
2002/0103027 A1 8/2002 Rowe et al.
2002/0142825 A1 10/2002 Lark et al.
2002/0151359 A1 10/2002 Rowe

FOREIGN PATENT DOCUMENTS

WO WO 02/32520 A1 4/2000

OTHER PUBLICATIONS

U.S. Appl. No. 60/181,576, filed Feb. 10, 2000, Robert A. Luciano et al.
U.S. Appl. No. 60/153,195, filed Sep. 10, 1999, Robert A. Luciano et al.
U.S. Appl. No. 09/784,237, filed Feb. 14, 2001, Robert A. Luciano et al.
U.S. Appl. No. 09/659,766, filed Sep. 11, 2000, Robert A. Luciano et al.
U.S. Appl. No. 09/420,221, filed Oct. 16, 1999, Robert A. Luciano.
U.S. Appl. No. 10/090,115, filed Feb. 27, 2002, Robert A. Luciano et al.
U.S. Appl. No. 09/419,748, filed Oct. 16, 1999, Robert A. Luciano et al.
U.S. Appl. No. 09/596,650, filed Jun. 19, 2000, Robert A. Luciano et al.

* cited by examiner

VOUCHER GAMING SYSTEMS AND METHODS

CROSS REFERENCE TO RELATED APPLICATIONS

This application claims the benefit of provisional application Ser. No. 60/332,306, filed Nov. 20, 2001. This application is also a continuation-in-part application of U.S. application Ser. No. 09/784,237, filed Feb. 13, 2001, which is now U.S. Pat. No. 6,685,559 issued on Feb. 4, 2004. All the related applications listed are expressly incorporated by reference in their entirety.

FIELD OF INVENTION

The present invention relates to gaming devices configured to allow players to play a game. In particular, the present invention relates to gaming devices that utilize vouchers or other information-carrying devices instead of cash.

BACKGROUND

Wagering and Non-Wagering Gaming Devices

Gaming devices may be categorized as non-wagering gaming devices ("NWGDs") and wagering gaming devices ("GWDs"). NWGDs are well known in the art. Examples of NWGDs are arcade games typically found in arcade establishments and vending machines. NWGDs allow players to play games when the players deposit a fee to play in the form of a token, a government-issued coin, or a card with pre-paid play value. NWGDs do not allow players to play for a stake, and players do not place a wager or a bet on NWGDs. Players deposit money in NWGDs usually to purchase goods or services. When a non-wagering game is completed, players usually receive a score, a good, a service, or a prize voucher. Players may use the prize voucher to redeem a prize at a prize terminal.

Clapper, Jr., U.S. Pat. No. 6,056,289 is an example of an NWGD. Clapper, Jr. discloses an electronic and mechanical apparatus utilizing both a voucher and a game ticket in the play of sweepstakes promotional games. The voucher and game ticket combination is dispensed from a dispensing apparatus or by a cashier upon introduction of payment. The voucher portion is for acquiring a specific good, such as a telephone card, which allows users to acquire long-distance access. The game ticket portion may be used for playing a promotional game. The game ticket portion is available to the purchaser of the voucher without any additional cost. The combination of both the voucher and the game ticket is geared toward enticing the user to acquire the voucher, as the user will more likely buy the voucher and game ticket combination than a voucher without the game ticket component.

Unlike NWGDs, wagering gaming devices ("WGDs") allow players to play games of chance. Players must place a wager or a bet, which may result in the player winning or losing the bet. The game outcome of WGDs is typically based on a random event, such as the occurrence of a predefined set of randomly generated numbers.

WGDs allow players to play games when the players place a wager or a bet. The players' bet may be in the form of government-issued currency or an information-carrying device with a credit amount. A demand exists for WGDs that utilize voucher devices because vouchers reduce the inconveniences associated with cash-based wagering transactions. One type of voucher currently used to initiate a game on WGDs is a promotional voucher. Promotional vouchers are usually issued or printed by devices, such as a standard personal computer and printer, rather than by a WGD on the floor of a casino. Promotional vouchers are generally mailed or distributed to customers or potential customers of a casino as an enticement to patronize the casino.

At least one problem with promotional vouchers is that they cannot usually be used in casinos other than the issuing casino. Another problem with promotional vouchers is that they have to be mailed to potential customers. This means that the vouchers may be lost in the mail, misplaced, or simply ignored. In addition, this adds an extra expense to the casino's operation. The applicants have found that it is desirable for gaming devices to issue vouchers to invite players already in the casino to try another product, such as a new game or a new restaurant, or to attend a casino's promotional event.

A WGD that uses vouchers to initiate a game and to collect remaining credits from the WGD appears to be disclosed in Saunders U.S. Pat. No. 6,280,326 (hereinafter, "'326"). '326 discloses a gaming system that issues a "cash-out" signal when a player quits playing and receives a "cash-in" signal when a player desires to play a game in the gaming system. The WGD in '326 accepts a ticket that a player inserts into a slot, reads the ticket, generates the cash-in signal, and allows the player to start playing. After the player finishes playing and quits the game, a ticket printer prints a coded value on a ticket in response to a cash-out signal from the gaming system and presents the ticket to the player.

At least one problem with '326 is that the player receiving the ticket is limited to redeeming the ticket for cash or using the ticket to play another game in that gaming system. Players desire to be able to do more with their tickets or vouchers, such as being able to directly use the vouchers to redeem merchandise. Another problem with '326 is that it dispenses a prize award readily in the form of a voucher. If the operator desires to execute an administrative procedure before dispensing the award, the operator cannot stall the award process. Yet another problem with '326 is that the vouchers do not have any disclosed advertising or marketing functions.

Game Competitions

Game competitions, such as slot tournaments and poker tournaments, are well known. Slot tournaments are usually held in a room filled with a number of slot machines. Each slot machine has a pre-set number of credits. Participants are given a certain length of time to play as many games as they can, and accumulate as many prizes or points as they can, with the pre-set number of credits. The participant with the most points at the end of the session wins and may proceed to the next level.

Game tournaments are exciting for players because of the spirit of competition they bring. Game tournaments build a festive atmosphere in a casino, as audiences can see and hear players competing for the same cause. Game tournaments have a wonderful potential of attracting more people to a casino, thereby generating more revenue for the casino.

Slot tournaments are usually promoted by mailing tournament information, which may include special room rates and comps, to members of a casino's mailing list. Game tournaments are also advertised in television, radio, or print media. One problem with these forms of advertising is that game tournaments remain perceived as being suited only for game experts or enthusiasts, or they are perceived as allowing only high rollers to participate. Another problem with these forms of advertising is that patrons may be hesitant to pay an entry fee just for trying the tournament. An efficient method of introducing the public to game tournaments is desired.

SUMMARY

Advantages

The various embodiments of the present invention may, but do not necessarily, achieve one or more of the following advantages:

1. the ability to reduce the inconveniences associated with cash-based wagering transactions;
2. the ability to ascertain the authenticity of each voucher being introduced into the gaming system;
3. the ability to maintain records of each voucher being issued by the gaming system;
4. provide a convenient method of awarding jackpot prizes;
5. provide a convenient method of awarding jackpot prizes while at the same time ensuring that certain procedures are implemented prior to awarding jackpots;
6. provide vouchers that introduce players to competitions or tournaments;
7. provide vouchers that allow players to test various games;
8. provide vouchers that allow players to test various games while at the same time allow players to win without direct out-of-pocket expense;
9. the ability to promote casino games, services, merchandise, and events using vouchers; and
10. the ability to encourage players to continue playing games of chance.

These and other advantages of the various embodiments of the present invention may be realized by reference to the remaining portions of the specification, claims, and abstract.

Brief Description of Certain Aspects of the Invention

The applicants have provided a method of gaming. The method of gaming comprises allowing a player to place a wager; allowing a player to play a game of chance; generating a randomly determined game outcome; providing a voucher to the player depending on the game outcome; allowing the player to present the voucher and redeem at least one prize using the voucher; and promoting a product using the voucher. The products being promoted may be, but not limited to, a game of chance, a gaming device, a restaurant, merchandise, or a competition.

The applicants have also provided a gaming system and related methods comprising a gaming device and a voucher mechanism in communication with the gaming device. The voucher mechanism is configured to present various types of vouchers to the player depending on a game outcome. The types of vouchers include, without limitation, a jackpot voucher, a merchandise voucher, a free play voucher, a mystery voucher, a competition entry voucher, and a restricted machine play voucher.

The applicants have further provided a method of gaming comprising: allowing a player to place a wager; allowing the player to play a game of chance on a player terminal; providing a regular prize for the game of chance, the regular prize being based on a randomly determined outcome; providing a jackpot prize for the game of chance, the jackpot prize more valuable than the regular prize, the jackpot prize being based on a randomly determined outcome; producing the randomly determined outcome that entitles the player to the jackpot prize; and providing the player with a voucher, the voucher being usable to redeem the jackpot prize.

The above description sets forth, rather broadly, the more important features of the present invention so that the detailed description of the preferred embodiment that follows may be better understood, and the contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Certain embodiments of the invention are shown in the following drawings where:

FIG. 14 being a continuation of FIG. 13.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. The term "voucher" is used interchangeably with the terms "coupon," "ticket," "stub," "form," "certificate," "memory storage device," and "card" to refer to an information-carrying device a player surrenders to obtain a prize, an article, service, or accommodation. The term "competition" is used interchangeably with the terms "contest," and "tournament" to refer to an event wherein two or more participants perform for a prize. The term "randomly generated outcome" is used to refer to a game outcome based on a random or at least partially random event.

Gaming System

Figure 1:
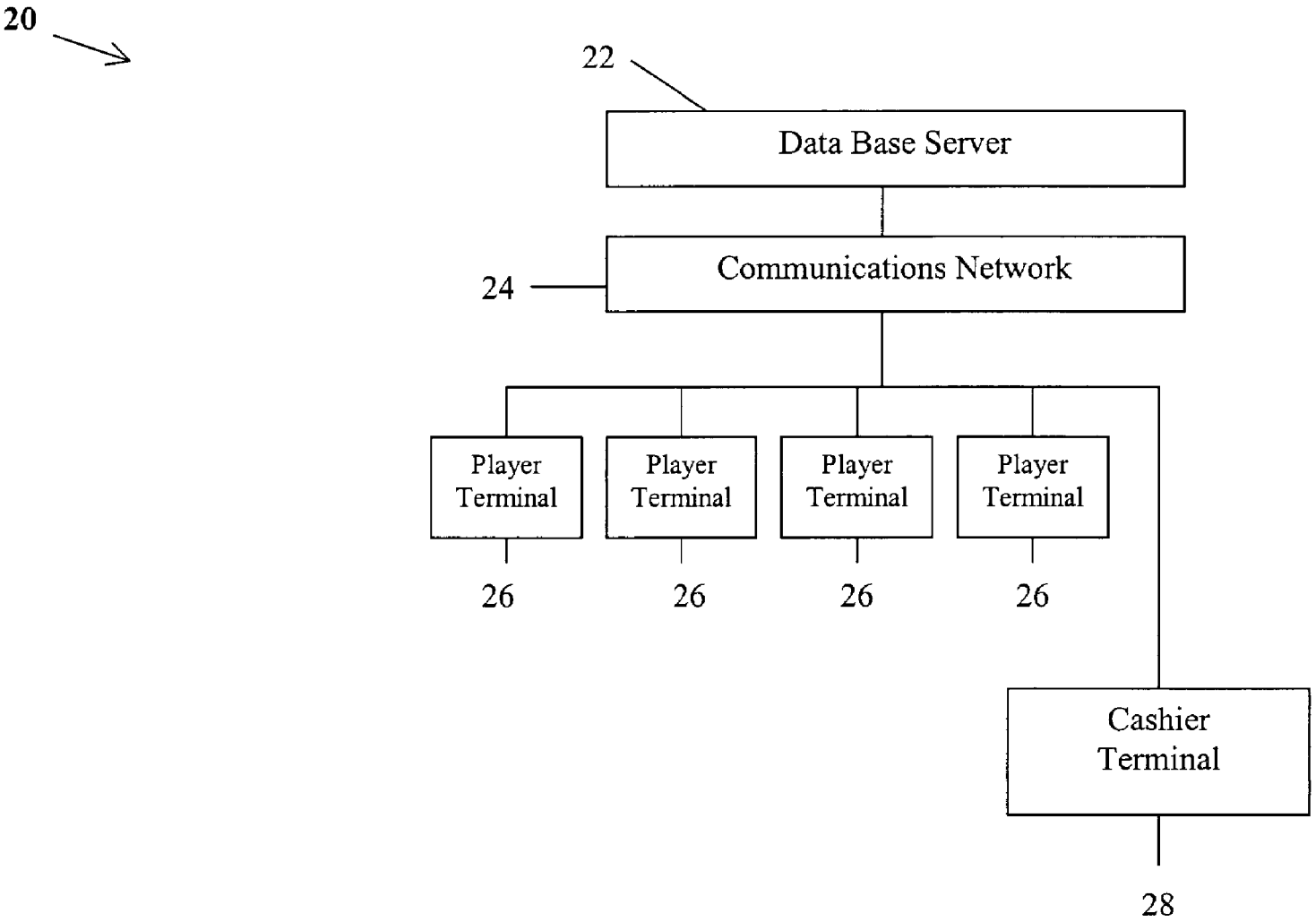
FIG. 1 is substantially a schematic diagram showing components of a preferred gaming system of the present invention.

Referring now to FIG. 1, a preferred embodiment of the present invention comprises a gaming system generally indicated by reference number 20. Gaming system 20 comprises a database server 22, communications network 24, player terminals 26, and cashier terminal 28. Database server 22 is preferably in communication with communication network 24, and database server 22 preferably stores a database of information. Database server 22 may be a Compaq 1850R database server using the Windows NT operating system and the Microsoft SQL 7.0 database software. Communication network 24 may be a network using a TCP/IP communication protocol.

During operation, player terminals 26 are preferably in communication with database server 22. Player terminals 26 may communicate with database server 22 through intermediate networks or encryption devices in order to record transactions, verify records, and change game parameters. Player terminals 26 and cashier terminal 28 are preferably interconnected with the communication network 24. Cashier terminal 28 may be serviced terminal having cashiers (not shown in FIG. 1) that accept or issue vouchers. Cashier terminal 28 may be an automated cashier terminal (not shown in FIG. 1) having a voucher reader (not shown) that accepts and reads vouchers being inserted by players and/or a voucher printer (not shown) that prints and presents vouchers to players.

Player Terminal

Player terminals 26 may be in a form of a gaming device (not shown in FIG. 1). Gaming device may be any of a large number of devices, including NWGDs and WGDs that are adapted to allow players to play a game. Examples of gaming devices include a slot machine that utilizes spinning reels, a gaming machine having a video display that provides an interactive game to the player, bingo devices, keno devices, or gaming tables known in the art. Player terminals 26 may have a wager acceptor, a coin slot, a bill acceptor, a card acceptor, a card reader, or a voucher acceptor known in the art.

Figure 2:
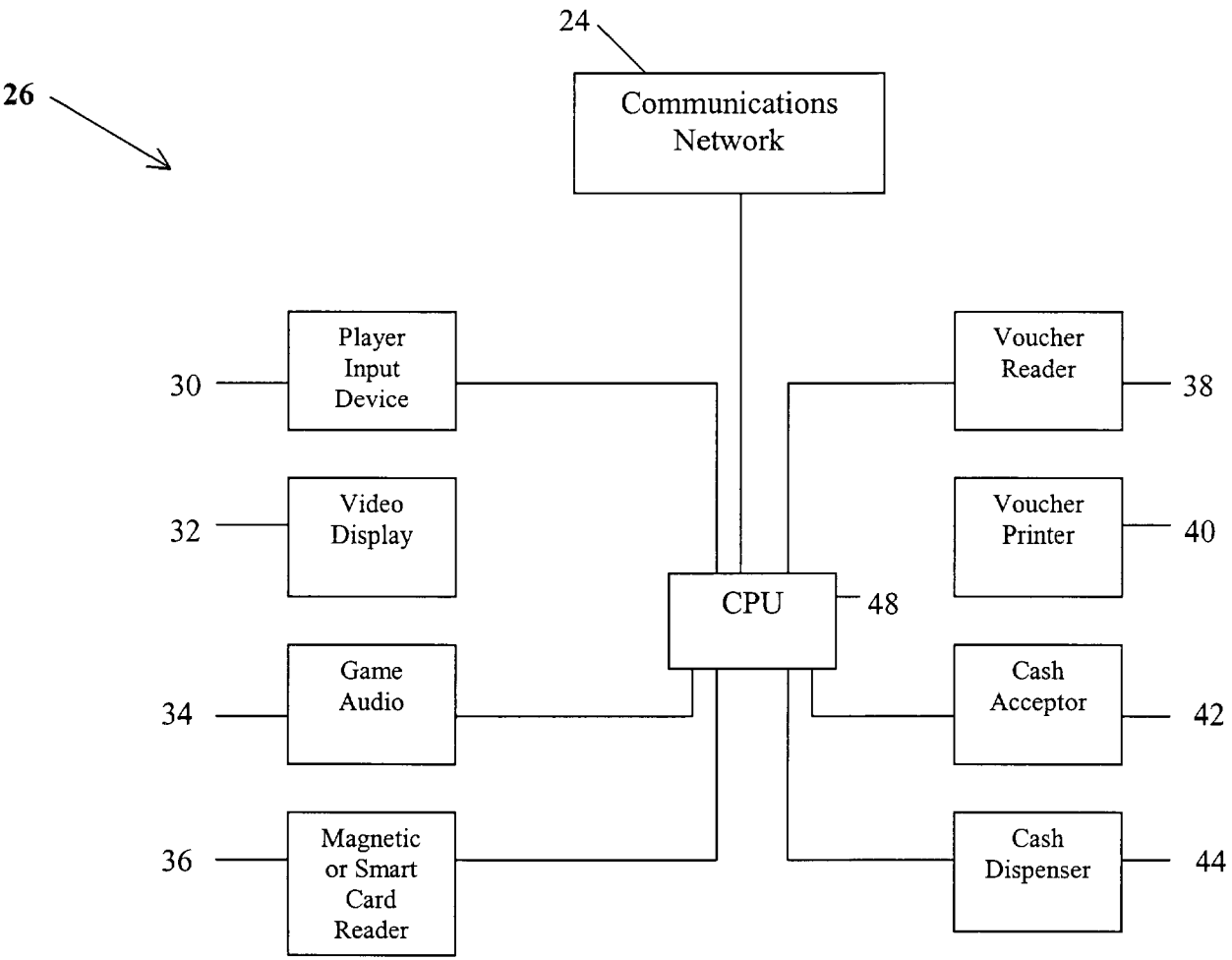
FIG. 2 is substantially a schematic diagram showing components of a preferred player terminal of the present invention.

Referring now to FIG. 2, player terminal 26 may further comprise the following components: player input device 30, a video display 32, an audio device 34, a magnetic or smart card reader 36, a voucher reader 38, a voucher printer 40, a cash acceptor 42, and a cash dispenser 44. All of these components are preferably in communication with a central processing unit (CPU) 48. CPU 48 preferably has a processor, input/output functions, and various memory capabilities, including non-volatile memory for critical data. CPU 48 is preferably in communication with the communications network 24. CPU 48 may be a conventional Intel x86 based processor or motherboard. CPU 48 may be a number of proprietary devices utilizing different processors, such as the Intel 80960. It is noted that gaming system 20 and player terminal 26 may utilize a single or a plurality of CPUs 48 configured to execute a variety of functions.

Video display 32 may be a Telco high-resolution 19-inch display. Voucher reader 38 and cash acceptor 42 may be combined into a single device, such as model WBA 13SS, available from JCM in Las Vegas, Nev. Voucher printer 40 may be a Transact technologies series 700 thermal printer. Voucher printer 40 may be the various voucher printer embodiments disclosed in U.S. Pat. No. 6,443,642, which is incorporated by reference. Voucher printer 40 may further include various printer tear bar embodiments disclosed in pending U.S. application Ser. No. 09/419,748, and pending U.S. application Ser. No. 09/596,650, which are incorporated by reference.

Cash dispenser 44 may be produced by Akahi-Seiko. Player terminals 26 may further include input devices 30 for activating player terminal 26 and for interacting with player terminal 26 when a game is played. Examples of input devices include handles, buttons, touch screens, a joystick, and other electrical and mechanical controls known in the art. The construction of player terminal 26 is within the ability of one skilled in the art. Many of the above components may be omitted, if desired.

Figure 3:
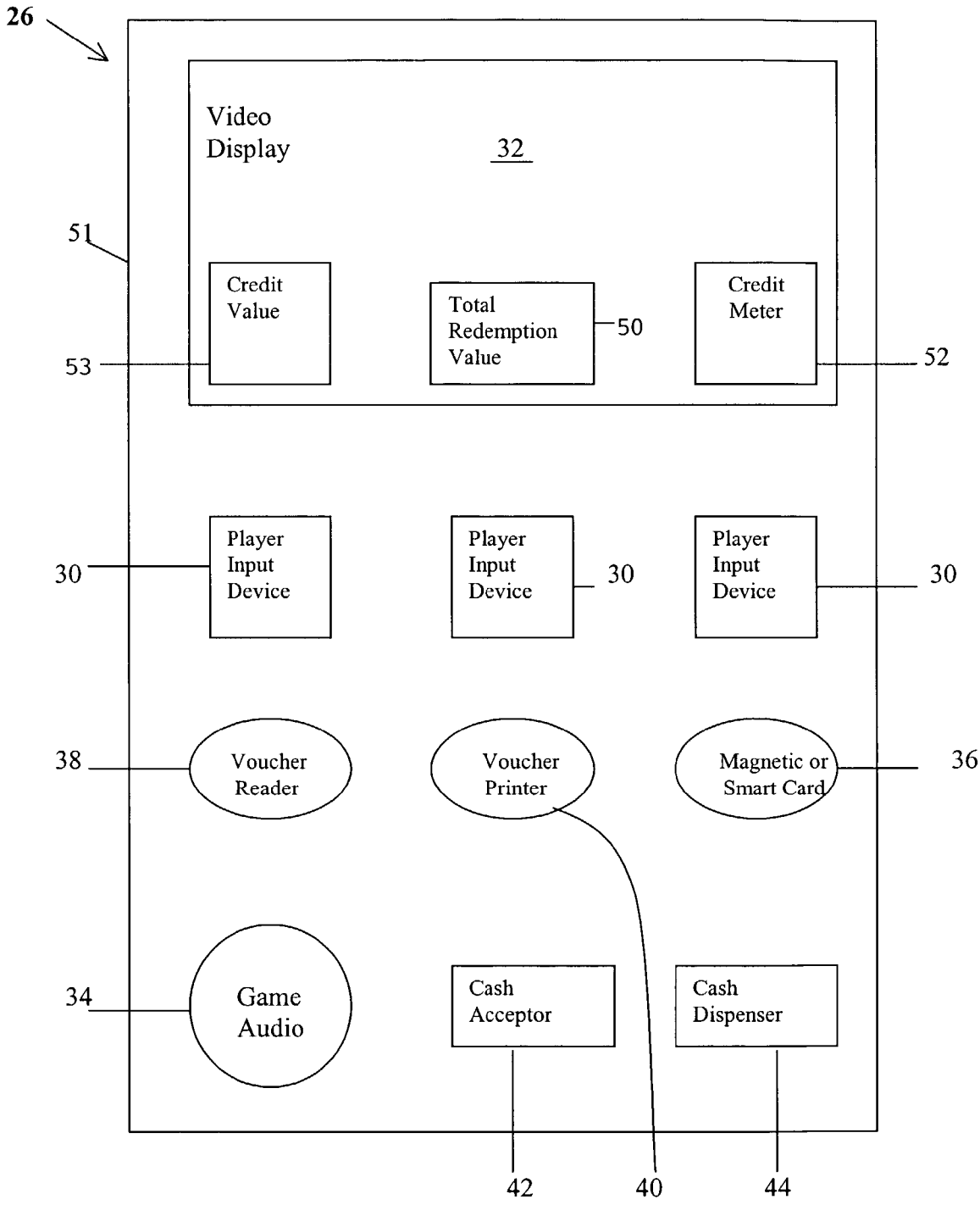
FIG. 3 is substantially a front view of the player terminal of FIG. 2.

Referring now to FIG. 3, a front view of a player terminal of a preferred embodiment of the present invention is shown. Player terminal 26 comprises a player input device 30, a video display 32, a game audio output device or speaker 34, a magnetic or smart card reader 36, a voucher reader 38, voucher printer 40, a cash acceptor 42, and a cash dispenser 44. All of these player terminal components are preferably mounted in a case or housing 51. Preferably, the components of player terminal 26 are mounted in case 51 in a manner that is ergonomically appealing to a user or game player.

Player terminal 26 is preferably controlled by an electronic controller that utilizes a random number generator (not shown in FIG. 3). The random number generator produces a random or pseudo random number for each game. The outcome of the game may be determined by comparing the random number to a table of predetermined outcomes. Player terminal 26 is preferably a gaming device having randomly generated outcomes of a fixed percentage payout. Randomly generated fixed percentage outcomes are generated by gaming machines employing various well-known mechanical systems or electro-mechanical devices employing statistical sampling algorithms, such as "Monte Carlo" algorithms and "Las Vegas" algorithms. See page 123, *Ultimate Zero and One*, Computing at the Quantum Frontier, by Colin P. Williams and Scott H. Clearwater, which is incorporated by reference. This payout percentage is usually regulated and established by various gaming commissions and agencies to insure that minimal payouts occur. Thus, these random generator gaming devices may also maintain databases that store information on each voucher issued.

Player terminal 26 may have various meters for presenting numerical information to the player. These meters may be separate devices or they may be displayed in video display 32. Video display 32 may present total redemption value 50, credit value 53, and number of credits 52. Total redemption value 50 is the total value the player currently has available for redemption. This is preferably displayed in units of the local currency. Credit value 53 is the value of a credit, which is also preferably displayed in units of local currency.

Voucher Types

Figure 4:
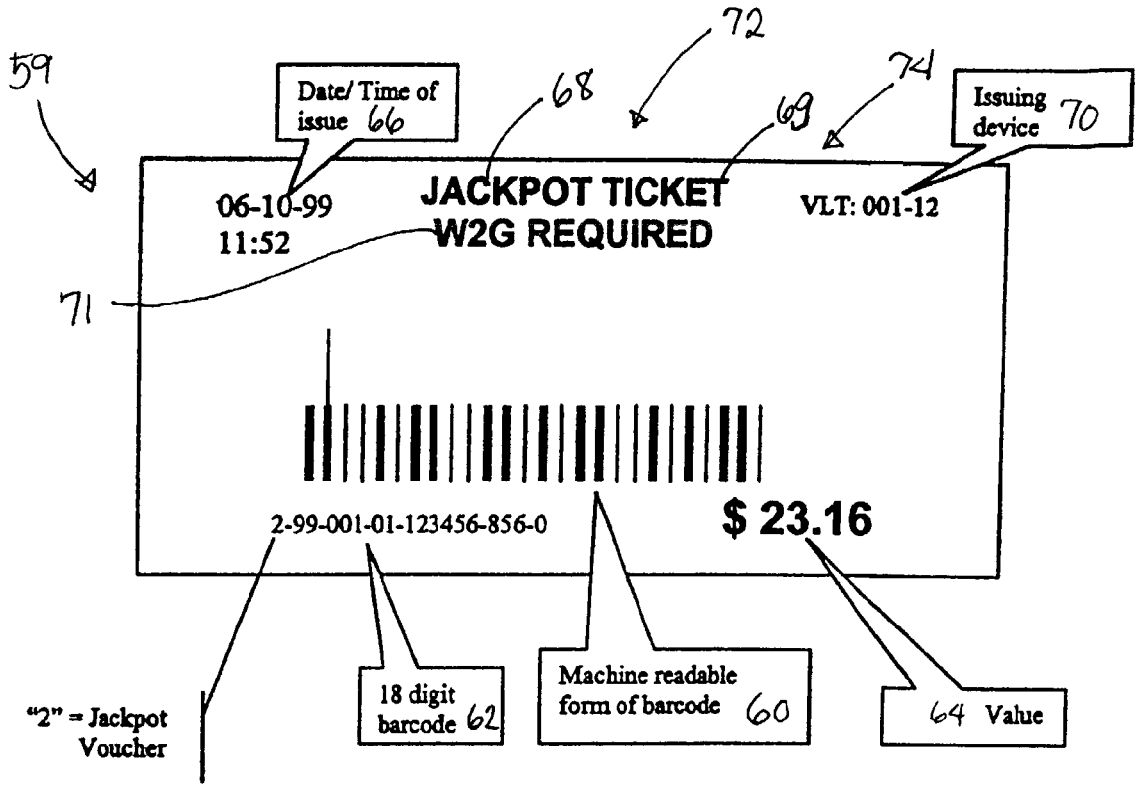
FIG. 4 is substantially a front view of a jackpot voucher of the present invention.

Player terminal 26 is preferably configured to receive vouchers or issue vouchers (not shown in FIG. 3). Referring now to FIG. 4, in general, vouchers 72 preferably have imprinted on them a machine readable code 60, a human readable code 62, an indication of a prize 64, a date and time stamp 66, an indication of voucher type 68, and an indication of origin of the voucher 70. The content of the vouchers and the fonts and designs of the imprints may vary. Vouchers may be made of various materials, including without limitation, media, paper materials, paperboard materials, thin plastic materials, thermal paper, and plasticized paper materials.

In order to serve as a unique identifier for each voucher 72, machine readable code 60 is preferably different for each voucher 72. Machine readable code 60 may be a code formed from a sequence of numbers, a sequence of characters, or a combination of both. In one preferred embodiment, machine readable code 60 is an 18 digit machine-readable Interleave 2/5 bar code. Machine readable code 60 preferably has at least one digit used to identify the type of voucher. In one preferred embodiment, the first digit specifies the type of voucher. Table 1 shows a preferred code structure for voucher 72.

TABLE 1

| Position | Content |
|---|---|
| 1 | Voucher Type Specifier<br>1 = cash voucher<br>2 = jackpot voucher<br>3 = merchandise voucher<br>4 = cash-out cash voucher<br>5 = competition entry voucher<br>6 = machine play voucher (non-cashable)<br>7 = restricted machine play voucher (non-cashable) |
| 2-17 | Unique identifier |
| 18 | Check Digit |

Human readable code 62 may be a sequence of numbers, a sequence of characters, or the combination of both, which human beings may read and understand. Among other properties, human readable code 62 allows attendants to determine whether they should allow players to redeem the voucher presented to them or whether they should direct the players to player terminals 26. If the voucher presented is a type that is redeemable at the cashier terminal 28, then indication of a prize 64 enables attendants to determine the prize they should award players.

Machine readable code 60 is preferably readable by voucher reader 38, which may then be transmitted to and stored in database server 22 via communications network 24, wherein machine readable code 60 forms a part of a voucher database. Table 2 shows a preferred content of a voucher database.

TABLE 2

| Field | Type | Description |
|---|---|---|
| Bar code | Numeric | Barcode information that identifies database record |
| Voucher status | Characters | Voucher status, wherein<br>Blank = unpaid<br>PD = paid<br>PP = pay in process<br>EX = expired |
| When issued | Date/Time | Date and time of voucher issuance |
| When expire | Date/Time | Date and time when voucher expires |
| Issue loc | Numeric | Identifies device that issued voucher |
| When paid | Date/Time | Identifies date and time of redemption |
| Where paid | Date/Time | Identifies device where voucher was redeemed |
| Who paid | Alphanumeric | User name if a user paid the voucher |
| Link | Numeric | Link to description of redemption restrictions, or prize type, type, or draw |

With continued reference to FIG. 4, an embodiment of a voucher, a jackpot voucher 59, is shown. Jackpot voucher 59 is preferably labeled as a jackpot voucher or ticket 69 for identification. Jackpot voucher 59 preferably has a reminder 71 to remind attendants or cashiers to execute a particular procedure associated with a jackpot win. In one preferred embodiment, reminder 71 is a reminder for attendants to fill out any form associated with jackpot wins, such as a "W2G" form or any current government mandated form. The number and types of reminders 71 may vary. Indication of a prize 64 for jackpot voucher 59 is preferably a jackpot value.

In one preferred embodiment, jackpot voucher 59 may only be used to redeem a jackpot prize or a jackpot prize plus a base game prize at a cashier terminal 28 and not a player terminal 26. This feature provides a way of ensuring that desired procedures associated with a jackpot win, such as filling out requisite forms, are executed after every jackpot win. Jackpot voucher 59 preferably may not to be used for wagering on another game of chance, or for redeeming other non-jackpot prizes. This feature provides another way of ensuring that desired procedures associated with a jackpot win, such as filling out requisite forms or ascertaining the validity of the jackpot win, are executed after every jackpot win.

It can be appreciated that jackpot voucher 59 provides a more convenient manner of handling jackpot payouts than using cash, especially when the jackpot payout involves a large award. It can also be appreciated that jackpot voucher 59 provides instant gratification or reward to players. Currently, when players hit the jackpot, players have to wait for an attendant. Some players doubt whether they actually won the jackpot or whether the machine just malfunctioned. When player terminal 26 dispenses jackpot voucher 59 to players, players do not have to wait for attendants, and players feel their jackpot win is valid, as confirmed by jackpot voucher 59. It can further be appreciated that jackpot voucher 59 promotes administrative efficiency. Attendants no longer have to be stationed close to every machine, as players may redeem jackpot prizes themselves.

Figure 5:
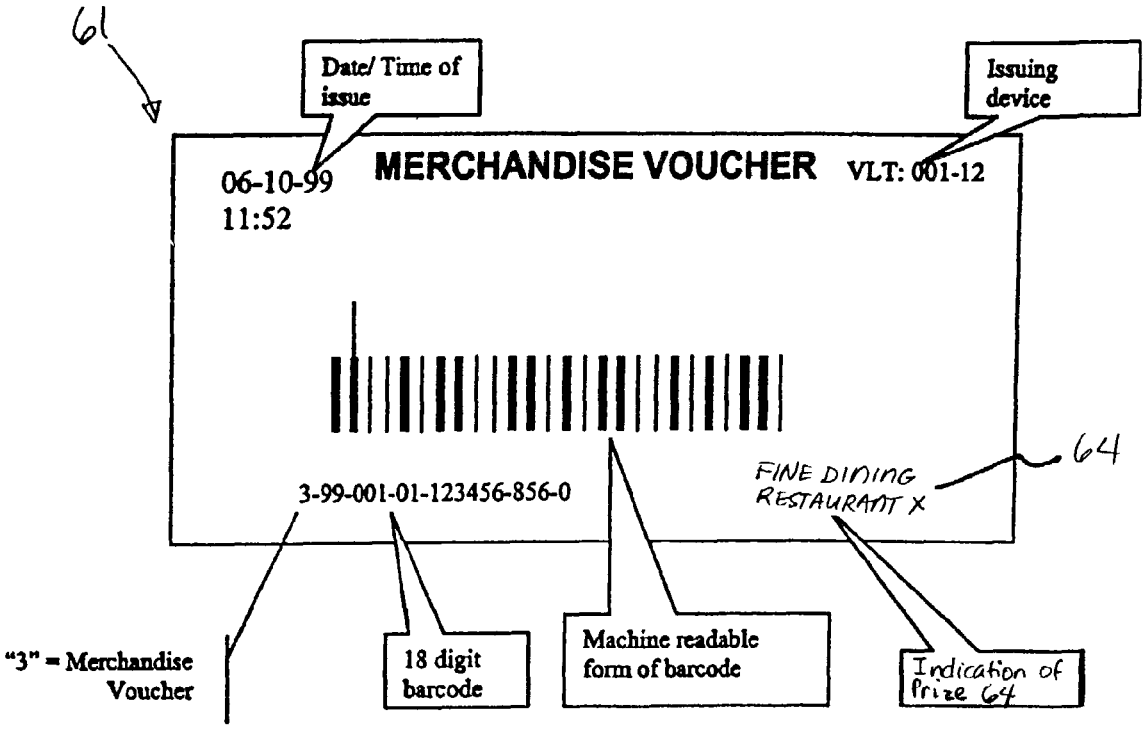
FIG. 5 is substantially a front view of a merchandise voucher of the present invention.

Referring now to FIG. 5, another embodiment of a voucher, a merchandise voucher 61, is shown. Merchandise voucher 61 is preferably labeled as "merchandise voucher" for identification. Indication of a prize 64 for merchandise voucher 61 is preferably the name of the merchandise. Merchandise may be in a form of goods, services, or any objects having value. Non-limiting examples of merchandise include jewelry, a car, a cruise package, or a concert package.

In one preferred embodiment, merchandise is in a form of a meal, refreshment, or food from a restaurant in the casino. Most casinos have different categories of restaurants. A category may be defined according to the ambiance of the restaurants, such as fine dining (high end), casual dining (low end), or semi-casual dining (middle). The ambiance of a restaurant may be judged, for example, on the interior decorations of the restaurant, the variety and presentation of the food, the variety of beverages, the price of food, or the atmosphere inside the restaurant. To further illustrate, a fine dining restaurant may be the casino's steakhouse that sells food from $50; a casual dining restaurant may be the casino's coffee shop that sells food within $1-$10; and a semi-casual dining may be a casino's Italian restaurant that sells food within $10-$30.

Another category may be according to the type of cuisine the restaurant serves, such as Italian, Chinese, or French cuisine. Another category may be according to the manner of service in the restaurant, such as buffet, coffee shop, full-service, or a bar. In every category, each restaurant is preferably ranked. The odds of wining the vouchers are preferably adjusted on CPU 48 according to the value of merchandise or the ranking of the restaurants. For example, fine dining may be ranked the highest among the restaurants categorized by ambiance. Consequently, a fine dining restaurant may have the lowest odds and therefore the most difficult voucher to win. The merchandise may be supported by a pool of money reserved by operators for marketing expenditures or by a pool of money obtained from players' wagers.

Merchandise vouchers 61 are preferably redeemable for merchandise only. This feature provides a way of preserving the marketing or advertising value of the voucher. Merchandise vouchers 61 may be used as tools for introducing restaurants or merchandise to players. By prohibiting the use of merchandise vouchers 61 to redeem other prizes, players will likely be introduced to the merchandise listed on merchandise voucher 61.

Figure 6:
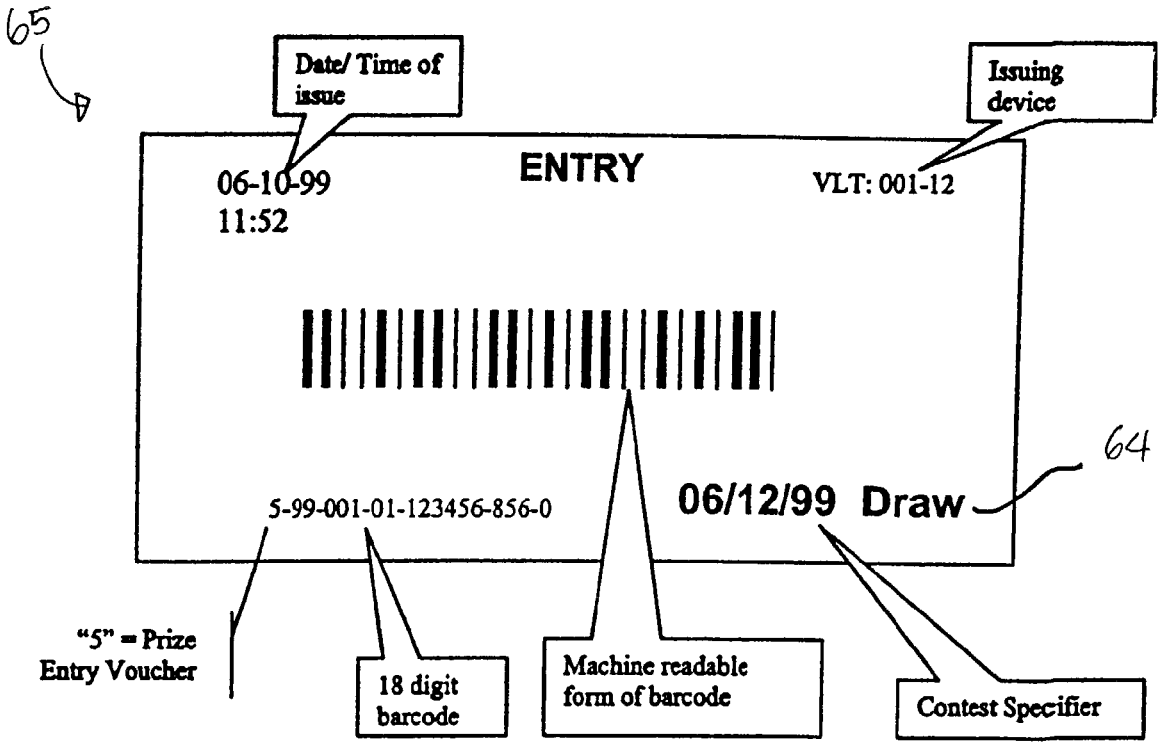
FIG. 6 is substantially a front view of a competition entry voucher of the present invention.

Referring now to FIG. 6, another embodiment of a voucher, a competition entry voucher 65, is shown. Competition entry voucher 65 is preferably labeled as "competition entry voucher" for identification. Indication of a prize 64 for competition entry voucher 65 is preferably in the form of specific information pertaining to the competition for which the voucher may be used as payment for the entry fee. The competition may be a slot, poker, bingo, keno, or other tournaments or competitions known in the art. The specific information may include the date, time, or place of the competition. Competition entry voucher 65 is preferably not redeemable for cash or other prizes to ensure player participation.

It can thus be appreciated that the present invention has certain embodiments that use a voucher as a tool for marketing or advertising tournaments. Patrons receiving competition entry vouchers 65 are likely to use them, and therefore likely to be introduced to competitions or tournaments. Once patrons are introduced to tournaments, they will no longer have the impression that competitions are only for experts, enthusiasts, or high rollers. These patrons will likely find tournaments fun and exciting, and they will likely play more tournaments in the future.

Figure 7:
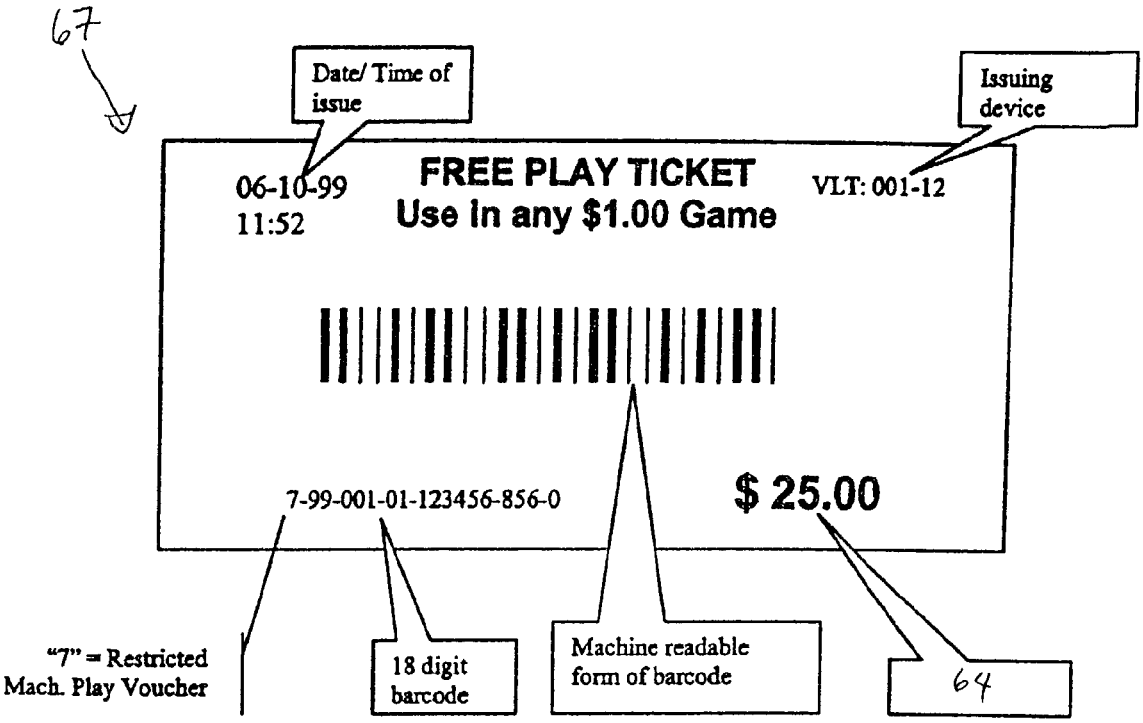
FIG. 7 is substantially a front view of a restricted play voucher of the present invention.

Referring now to FIG. 7, another embodiment of a voucher, a restricted machine play voucher 67, is shown. Indication of a prize 64 for restricted machine play voucher 67 is preferably a credit value, which informs the player how many credits he may use. Restricted machine play voucher 67 is preferably usable only on certain pre-selected machines, which may be games casinos are trying to promote. It can be appreciated that restricted machine play voucher 67 is useful in introducing new games to patrons.

Figure 8:
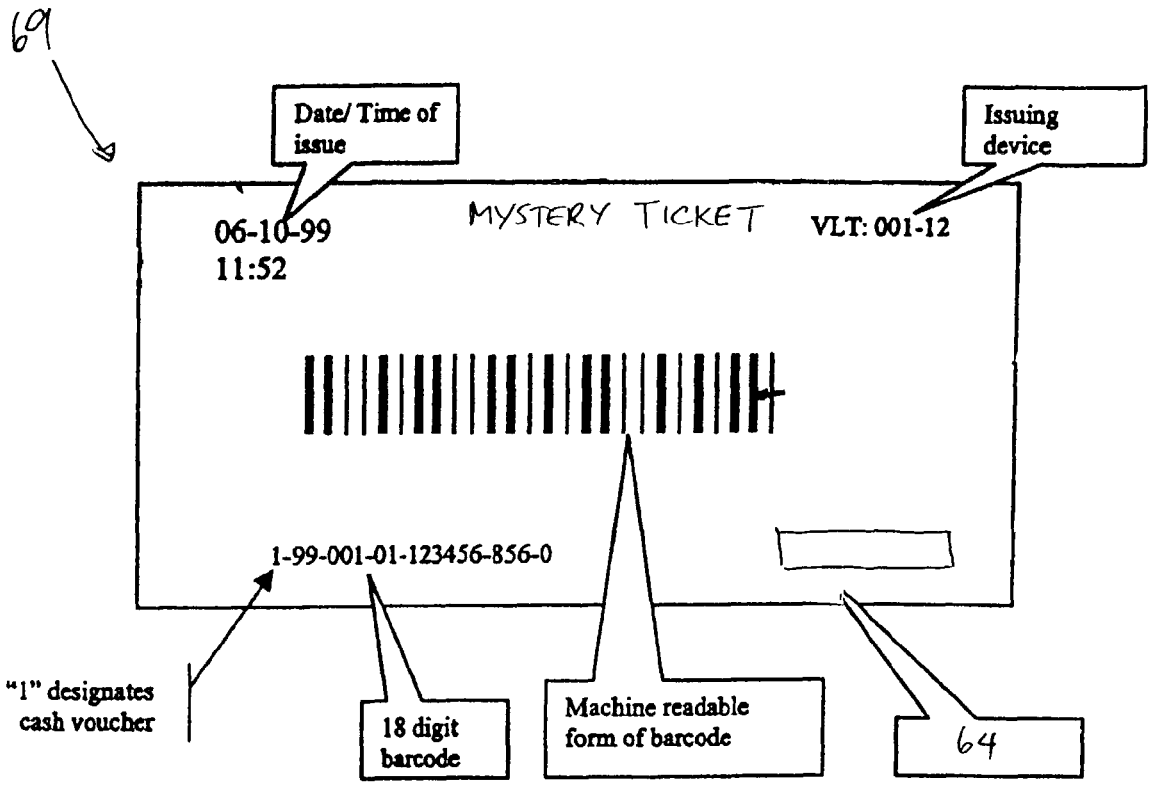
FIG. 8 is substantially a front view of a mystery voucher of the present invention.

Referring now to FIG. 8, another embodiment of a voucher, a mystery voucher 69, is shown. In one embodiment, a removable coating 73 may cover indication of a prize 64. In another embodiment, indication of a prize 64 may simply be in a form of a question mark or any mark and/or an instruction for the player to insert the mystery voucher in a player terminal 26 to find out about the prize It is noted that this embodiment provides a way of enticing a player to use another player terminal 26.

Mystery vouchers 69 may further be used by casino operators to formulate new and/or temporary games. For instance, when casino operators feel more marketing effort needs to be given to a particular player terminal, casino operators may advertise that the player terminal is capable of awarding a mystery prize. The player terminal may then be programmed to print mystery voucher 69 that offers a mystery prize.

In one embodiment, the mystery prize may be supported by a pool of money obtained from players' wagers. In one preferred embodiment, the mystery prize may be supported by a pool of money reserved by operators for marketing expenditures. In this preferred embodiment, the mystery prize, although unknown, is preferably in a predetermined range, having both a minimum value and a maximum value. The amount won by the holder of the voucher is then determined in one of two preferred ways. A first preferred embodiment will use a random event to determine where in the predefined range the voucher's value will actually be, and will further be determined upon insertion of the voucher back into a player terminal 26. In a second preferred embodiment, the amount of mystery voucher is determined at the time of issuance and is associated with the voucher's ID in a database. Upon insertion into a players terminal, the voucher ID is used to retrieve the predetermined value and that value is awarded to the player. In the second preferred embodiment, the predetermined value may be chosen using a deterministic method (i.e. a set of prize amounts awarded in the sequence in which they were generated) or using a probabilistic method.

It can thus be appreciated that mystery vouchers 69 provide a marketing opportunity for casino operators. It can also be appreciated that by initially hiding the prize from the player, an element of surprise is added to the game.

Methods of making vouchers with removable coatings are well known in the art and are commonly used to make instant lotto tickets. Materials for the removable coating may include aluminum permeated latex, ink, and peel-off material such as stickers. The removable coating is preferably opaque.

It is noted that the various voucher types described above or selections thereof above may be combined in a single voucher. When various voucher types are combined in a single voucher, the single voucher may be configured to have one usable voucher type or multiple usable voucher types. It is further noted that CPU 48 or database server 22 may store the various voucher types described above or selections thereof, and CPU 48 may cause voucher printer 40 to print and dispense varying vouchers having one usable voucher type or multiple usable voucher types.

Game Methods

When a player plays a game on player terminal 26, player terminal 26 is configured to produce a game outcome. A game outcome may be a winning game outcome, a losing game outcome, a bonus outcome, or an even game outcome. A losing game outcome may be defined as an event wherein the random number generator generates a set of random numbers that does not match the predefined set of numbers. A winning game outcome may be defined as an event wherein the random number generator generates a set of random numbers that matches a predefined set of numbers. An even game outcome may be defined as an outcome that is neither a losing game outcome nor a winning game outcome. A bonus outcome may be defined as an outcome entitling a player to play a secondary game. A variety of bonus games known in the art may be used as a secondary game.

In one preferred embodiment, player terminal 26 is configured to produce either a winning game outcome or a losing game outcome. There is preferably a plurality of predefined sets of winning numbers. Each set of winning number may have a corresponding prize. The set of winning number and the corresponding prize may be listed on a payout table known in the art. In an alternative embodiment, players may be entitled to at least one consolation prize after obtaining a losing outcome. The consolation prize may be any of the vouchers described below.

In another alternative embodiment, player terminal 26 may provide a primary game and a secondary game to a player. The secondary game may or may not allow player participation. In one embodiment, the secondary game may also be a game that allows players to exercise skill to determine the secondary game outcome. In another embodiment, the secondary game may be an apparent skill game wherein the player is allowed to use skill in playing the secondary game, but the secondary game outcome is a predetermined randomly generated outcome. In yet another embodiment, the secondary game may be a game that does not allow player to exercise skill. The player may be entitled to a bonus prize after playing the secondary game. The bonus prize may be any of the vouchers described below. The bonus prize may be solely the prize obtained from playing the secondary game or may be the prizes from the both the primary and secondary games.

Gaming system 20 preferably has a plurality of prizes including regular prizes, special awards, and a jackpot prize. Special awards may be defined as merchandise vouchers 61, competition entry vouchers 63, restricted play vouchers 65, and machine play vouchers 67. Regular prizes may be defined as prizes that are not special awards. A jackpot prize may be greater in value than the regular prizes.

Figure 9:
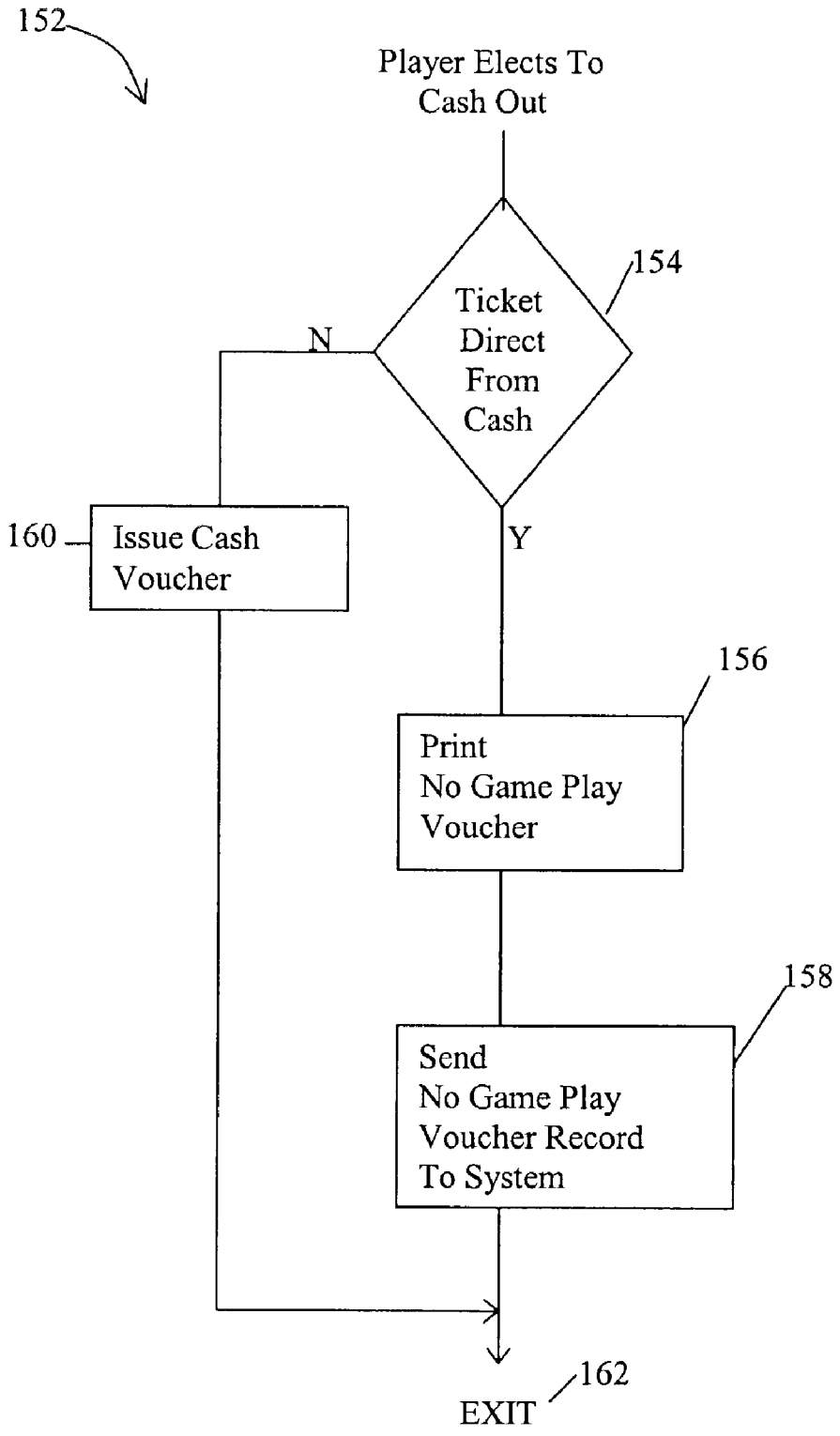
FIG. 9 is substantially a flowchart showing a process of allowing a player to cash out accumulated credits including the issuance of a cash-out voucher.

If game play on player terminal 26 results in a losing game outcome, or in a winning game outcome wherein the win amount is less than the jackpot limit and the win outcome is not a special award, the player may elect to cash out. FIG. 9 shows a preferred method 152 that gaming system 20 executes when the player elects to cash out. At step 154, player terminal 26 queries whether the player used cash to play. If the player used cash to play and the player elected to cash out, voucher printer 40 of player terminal 26 proceeds to print a "no game play" voucher at 156. A "no game play" voucher is a voucher having cash value, but the voucher may not be used to activate a game. Method 152 proceeds to step 158 wherein voucher information, such as listed in table 2 above, may be transmitted to database server 22 for storage through communications network 24. No game play voucher may finally be presented to the player at step 162.

Referring back to step 154, if the player did not use cash to play and the player elected to cash out, voucher printer 40 of player terminal 26 proceeds to print a cash-out voucher at 160. A "cash-out" voucher is a voucher having cash value and may be used to obtain cash or to wager in a game. Cash-out voucher may be presented to the player at step 162. Alternatively, method 152 may proceed to step 158 prior to 162, wherein cash-out voucher information, such as listed in table 2 above, may be transmitted through communications network 24 to database server 22 for storage.

Figure 10:
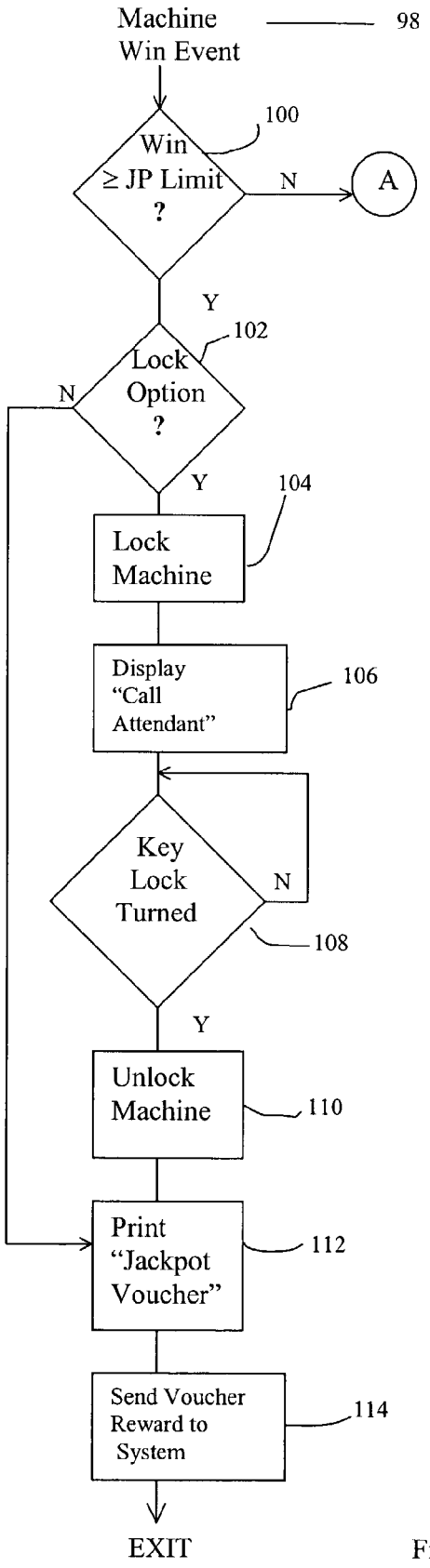
FIG. 10 is substantially a flowchart showing a gaming system process for determining the appropriate voucher type to issue; the flowchart further showing a preferred process for issuing a jackpot voucher.

Referring now to FIG. 10, when a winning outcome occurs at step 98, player terminal 26 determines whether the prize is greater than or equal to a jackpot limit at step 100. If the prize is greater than or equal to the jackpot limit, player terminal 26 queries whether or not to disable itself at step 102. Player terminal 26 is preferably programmed to disable itself at step 102 when the prize is greater than the jackpot limit. If player terminal 26 does not disable itself at step 102, gaming system 20 proceeds to step 112 and prints a jackpot voucher (discussed further below). At step 114, voucher reader 38 obtains jackpot voucher information, such as machine readable code 60, an indication of a prize 64, a date and time stamp 66, an indication of voucher type 68, and an indication of the origin of the voucher 70. Voucher reader 38 sends information through communications network 24 to be stored in database server 22.

If player terminal 26 does disable itself or enters a locked mode at step 104, player terminal 26 becomes inaccessible to the player. Input device 30 of player terminal 26 may be de-activated. Video display 32 may display a message to the player indicating the locked mode. At step 106, video display 32 may further display a message to the player directing the player to call an attendant. Alternatively, game audio 34 may be activated to alert an attendant. Player terminal 26 may further have a flashing light to alert an attendant. Player terminal 26 remains in the locked mode until it detects a signal to switch to the unlocked mode at step 108. Once player terminal 26 switches to unlocked mode at step 110, player terminal proceeds to steps 112 and 114 described above.

Figure 11:
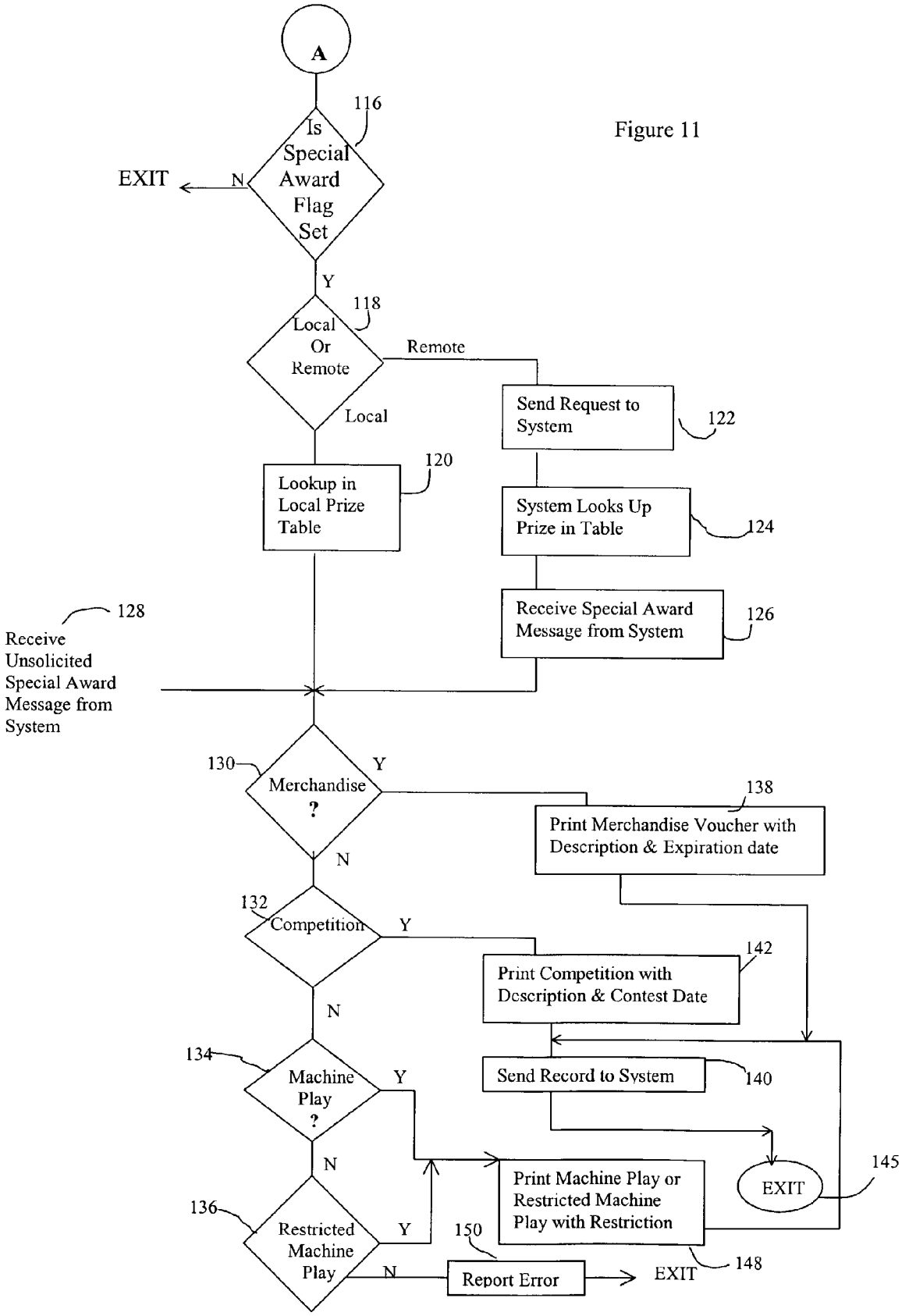
FIG. 11 is substantially a flowchart showing a gaming system process for determining the appropriate voucher type to issue; the flowchart being a continuation of FIG. 10.

Referring back to step 100 wherein player terminal 26 determines whether the prize is greater than or equal to a jackpot limit, if player terminal 26 determines that the prize is not greater than or equal to a jackpot limit, gaming system 20 executes the process shown in FIG. 11. Referring to FIG. 11, gaming system 20 queries whether game play is entitled to a special award at step 116. If game play is entitled to special award, gaming system 20 determines whether player terminal 26, in which the game play occurred, is local or remote at step 118. If player terminal 26 is local, then gaming system 20 refers to a prize table at step 120 to determine the prize.

If player terminal 26 in which the game play occurred is remote, then, at step 122, player terminal 26 sends a request for a special award or prize determination to gaming system 20 through communications network 22. At step 124, gaming system 20 refers to the prize table at step 120 to determine the prize. At step 126, player terminal 26 receives special award message or prize type from gaming system 20.

Once player terminal 26 knows the prize type, player terminal 26 may receive unsolicited special award message 128 from gaming system 20. Player terminal 26 queries whether the prize type is a merchandise prize 130, competition entry form 132, machine play voucher 134, or restricted machine play voucher 136.

If the special award is a merchandise award at step 130, voucher printer 40 of player terminal 26 prints the voucher preferably with the merchandise identification and the expiration date at step 138. Of course, voucher content may vary. The method proceeds to step 140 wherein voucher information, such as listed in table 2, may be transmitted to database server 22 for storage through communications network 24. The merchandise voucher may finally be presented to a player at step 146.

If the special award is not a merchandise award at step 130, the method proceeds to step 132 and queries player terminal 26 whether the special award is a competition entry voucher. If the special award is a competition entry voucher, the method proceeds to step 142 wherein voucher printer 40 of player terminal 26 prints a competition entry voucher preferably with information pertaining to the competition, such as the date, time, place, and type of the competition. Next, the method proceeds to steps 140 described above. At step 145, competition entry voucher may be presented to the player.

If the special award is not a merchandise award at step 130, or competition entry voucher at step 132, the method proceeds to step 134 and queries player terminal 26 whether the special award is a machine play voucher. If the special award is a machine play voucher, the method proceeds to step 148 wherein voucher printer 40 of player terminal 26 prints a machine play voucher preferably with information pertaining to the machine play, such as the amount player is entitled to play. Next, the method proceeds to steps 140 described above. At step 145, machine play voucher may be presented to the player.

If the special award is not a merchandise award at step 130 or a competition entry voucher at step 132 or a machine play voucher at step 134, the method proceeds to step 136 and queries player terminal 26 whether the special award is a restricted play voucher. If the special award is a restricted play voucher, the method proceeds to step 148 wherein voucher printer 40 of player terminal 26 prints the respective voucher (restricted machine voucher) preferably with information pertaining to the type of machine the player is entitled to play. Next, the method proceeds to steps 140 described above. At step 145, a restricted play voucher may be presented to the player.

If the special award is not a merchandise award at step 130 or a competition entry voucher at step 132 or a machine play voucher at step 134 or a restricted play voucher at 136, the method proceeds to step 150 wherein player terminal 26 reports an error to gaming system 20. Gaming system 20 may reset player terminal 26 or alert an operator to correct the error. It is noted that the flowchart in FIGS. 9, 10, and 11 only shows one possible embodiment. Some of the steps in the flowchart may be varied, changed in order, or eliminated and still fall within the scope of the present invention.

Figure 12:
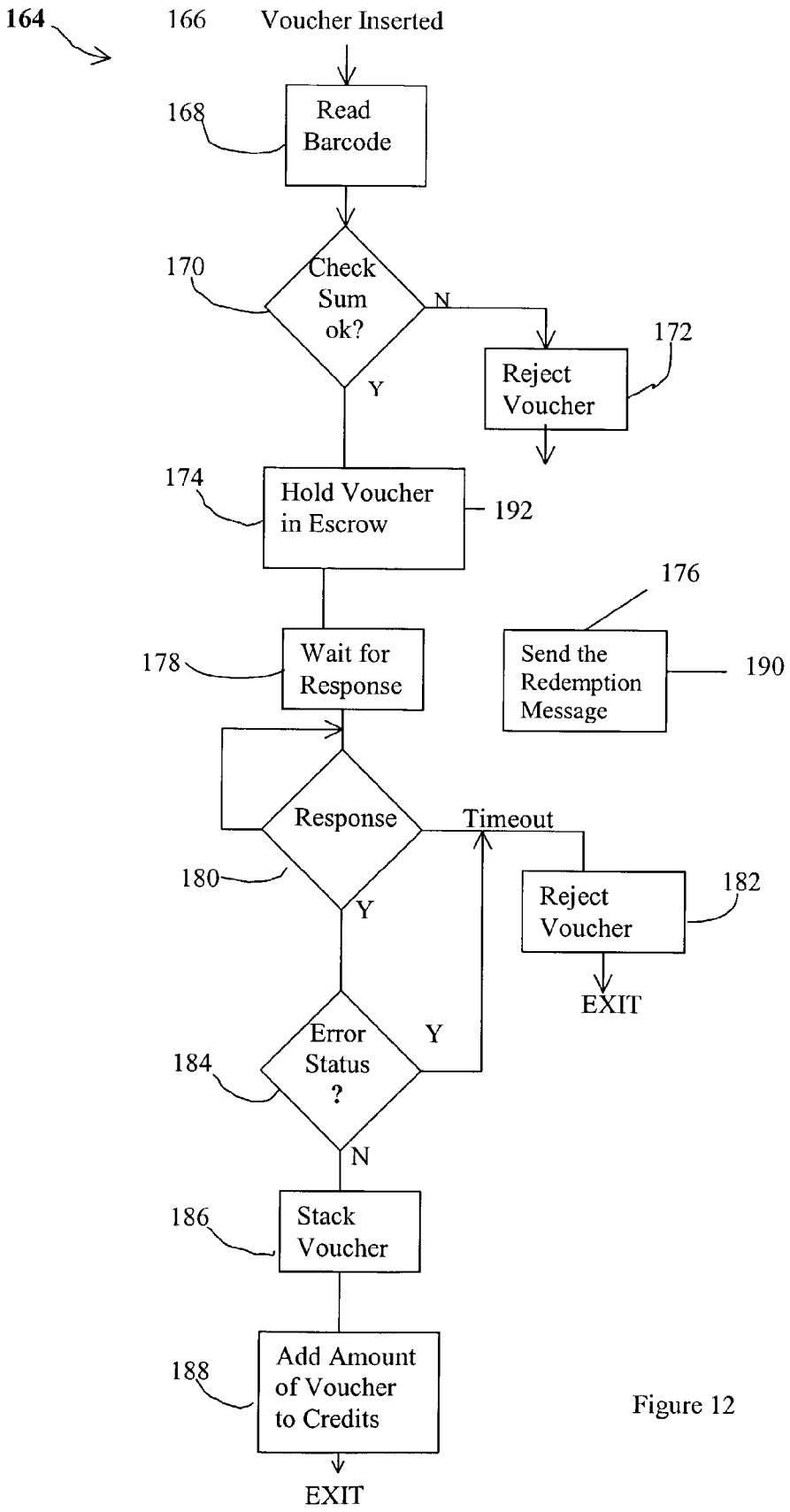
FIG. 12 is substantially a flowchart showing a gaming system process for accepting a voucher.

Referring now to FIG. 12, after the player receives a voucher of a specific type, the player may insert that voucher into player terminal 26. Gaming system 20 executes a game machine voucher acceptance method 164. Once the voucher is inserted at step 166, voucher reader 38 reads machine code 60 of the voucher at step 168. At step 170, voucher reader 38 and CPU 48 perform a voucher authenticity test referred to as the "check sum" test. One way of conducting the check sum test is by adding the value of each digit of machine code 60 and comparing the sum with the previously recorded sum of machine code 60 of the originally issued voucher. If the sums do not match, voucher reader 38 rejects the voucher at step 172. Various other voucher verification techniques or voucher authenticity tests known in the art may be used.

If the sums match, method 164 proceeds to step 174 where the voucher is held in escrow. Next, at step 176, player terminal 26 sends a redemption message, which is a message conveying the redemption voucher value, to gaming system 20. Player terminal 26 waits for a response from gaming system 20 at step 178, as the gaming system executes redemption process 190 discussed below. At step 180, if the response is not received after a predetermined amount of attempts to detect a response, player terminal 26 goes into a timeout or disabled mode. Player terminal 26 then rejects the voucher at step 182. If player terminal 26 receives a timely response, player terminal 26 may detect for an error signal at step 184. Causes of error signals are explained below. If player terminal 26 does not detect any error signal, player terminal 26 stacks the voucher at step 186. At step 188, player terminal 26 adds the amount of the voucher to the credits recorded in database server 22. It is noted that step 188 may not be applicable for certain voucher types, if desired, such as jackpot vouchers.

Figure 13:
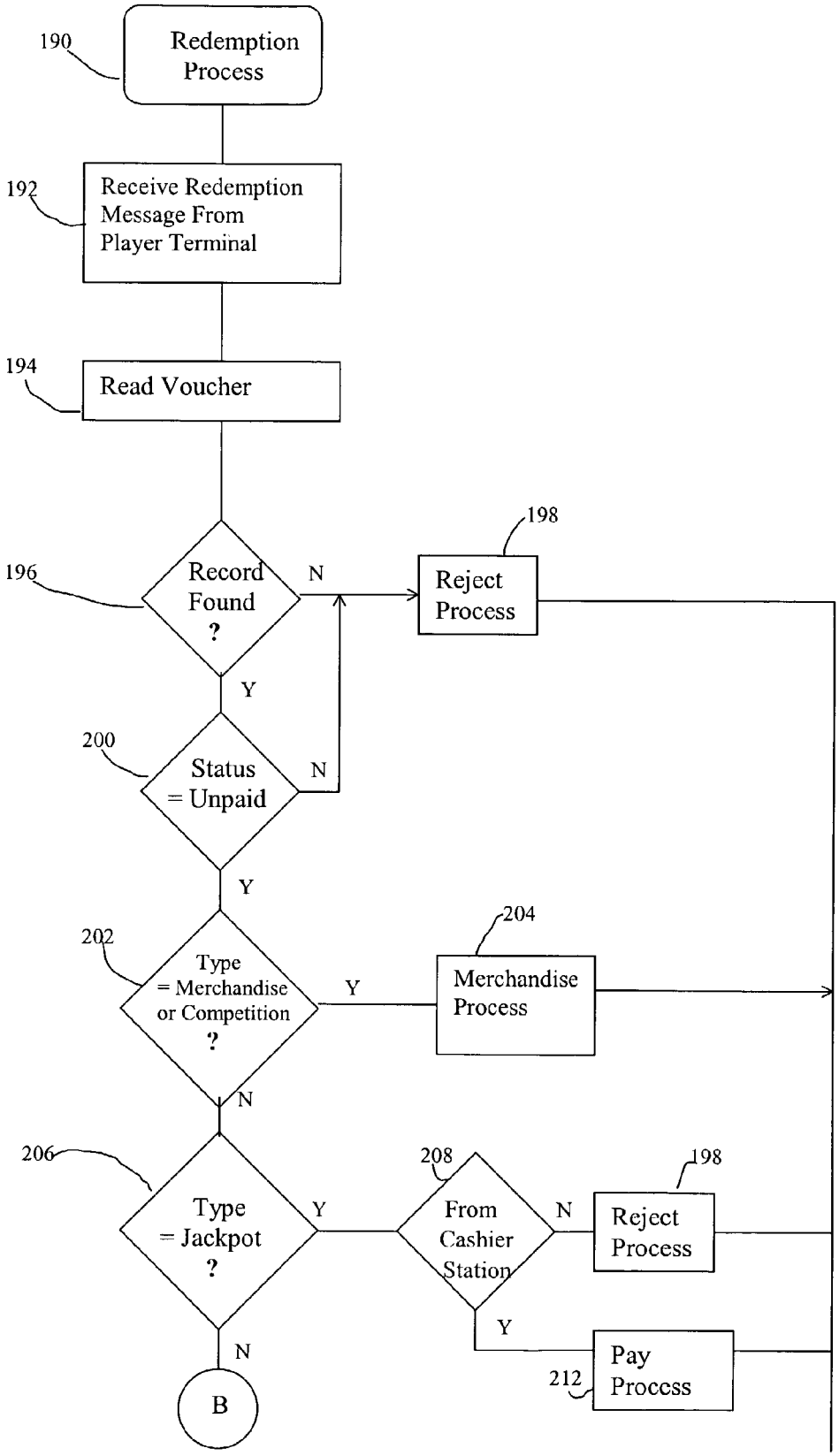
FIG. 13 is substantially a flowchart showing a gaming system process for allowing players to redeem their vouchers.

Referring now to FIG. 13, a preferred redemption process 190 is shown. Redemption process 190 starts when gaming system 20 receives a redemption message from player terminal 26 (192) (which is after step 176 of FIG. 12). Gaming system 20 reads the voucher database from database server 22 to check the authenticity of machine code 60 of the voucher (194). At step 196, gaming system 20 determines whether the machine code record of the voucher is found. If the record is not found, then process 190 proceeds to reject process 198, which is discussed below.

If the record is found at step 196 in database server 22, gaming system 20 queries whether the voucher has been paid (200). If the voucher has previously been paid, method 190 proceeds to reject process 198, which is discussed below. If the voucher has not been paid, gaming system 20 queries whether the voucher is a merchandise voucher type or a competition entry voucher at step 202. If the voucher is either of these types, then method 190 proceeds to non-cash process 204, which is discussed below. If the voucher is neither a merchandise voucher nor a competition entry voucher, gaming system 20 determines whether the voucher is a jackpot voucher at step 206.

If the voucher is a jackpot voucher, gaming system 20 queries whether the voucher was inserted and redeemed at a cashier terminal (208). If the voucher was inserted and redeemed at a cashier terminal, then the player will be paid upon execution of pay process 212 discussed below. If the voucher was not inserted and redeemed at a cashier terminal, then the player will not be paid and the voucher will undergo reject process 198 (discussed below). It can be appreciated that this optional but preferred feature of requiring jackpot vouchers to be redeemed at cashier terminals helps ensure that government form W2G is filled out (or other desired administrative processes are executed) every time a player redeems a jackpot prize. Additionally, the same optional but preferred feature aids in determining the authenticity of the jackpot voucher and provides added security to the casino.

Figure 14:
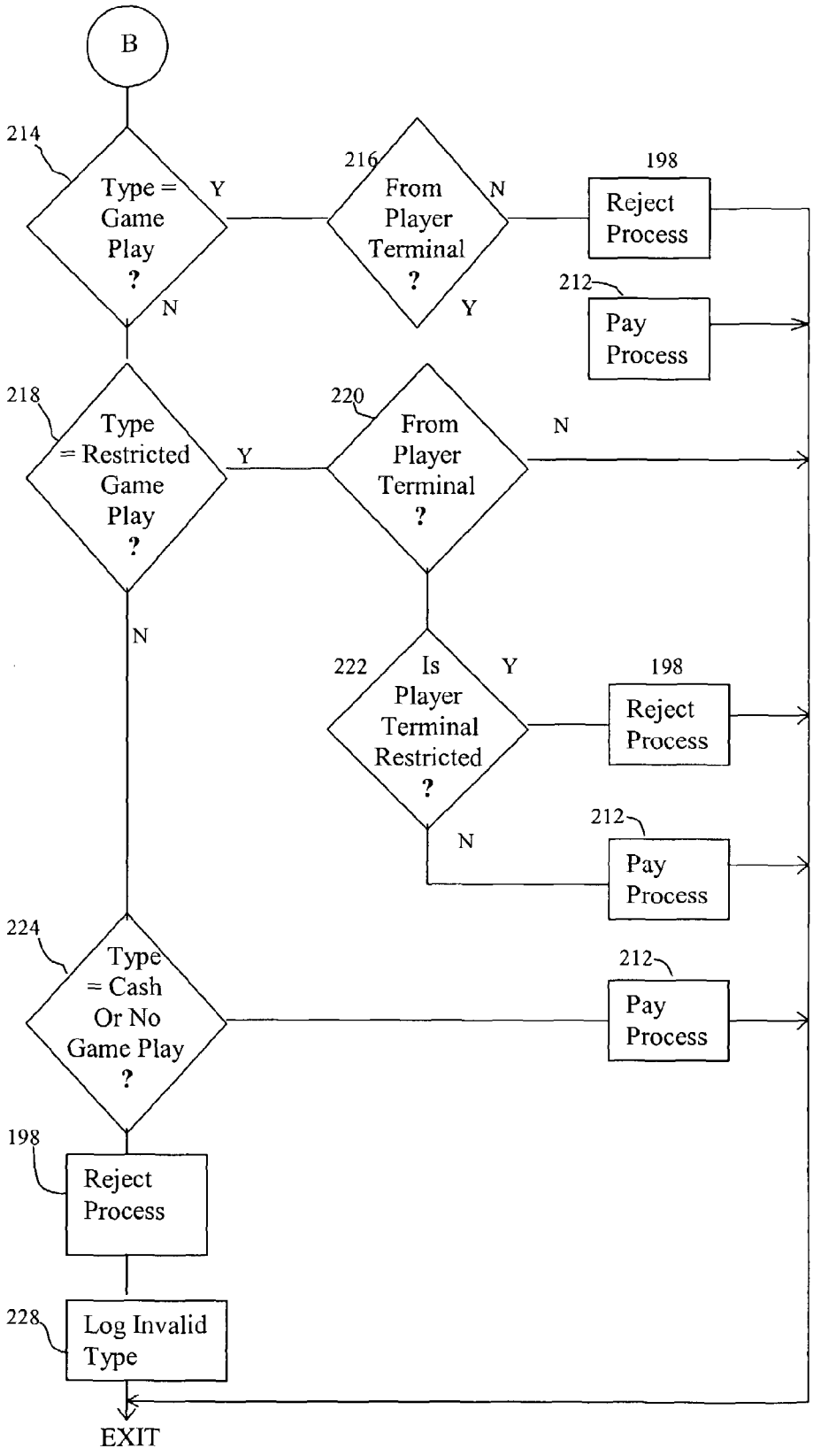
FIG. 14 is substantially a flowchart showing a gaming system process for allowing players to redeem their vouchers.

If the voucher is not a jackpot voucher, gaming system 20 queries whether the voucher is a game play voucher (step 214 in FIG. 14). Referring now to FIG. 14, if the voucher is a game play voucher, gaming system 20 queries whether the game play voucher was redeemed at player terminal 26 (step 216). Game play vouchers are preferably redeemable at player terminals 26, and not cashier terminals 28, so that players can proceed to playing games immediately and so that cashiers are relieved of having to direct players to player terminals 26. Thus, if the game play voucher was redeemed at player terminal 26, pay process 212 (discussed below) is executed. If the game play voucher was not redeemed at player terminal 26, reject process 198 is executed.

If the voucher is not a game play voucher at step 214, gaming system 20 queries whether the voucher is a restricted game play voucher at step 218. At step 220, gaming system 20 ensures that game play voucher was redeemed at a player terminal 26. At step 222, gaming system 20 queries whether player terminal 26 is compatible for allowing game play on wagers made from game play vouchers. If player terminal 26 is not compatible, then reject process 198 (discussed below) is executed. If player terminal 26 is compatible, then the player is allowed to play a game on player terminal 26 upon execution of pay process 212 (discussed below).

If the voucher is not a restricted game play voucher at step 218, gaming system 20 queries whether the voucher is a cash or a cash-out type voucher at step 224. If the type of voucher is either of these types, then pay process 212 (discussed below) is executed. Otherwise, reject process 198 (discussed below) is executed. If the inserted voucher for redemption does not fall into a recognized voucher type, step 228 is executed wherein a record of an invalid type of voucher is created.

Figure 15:
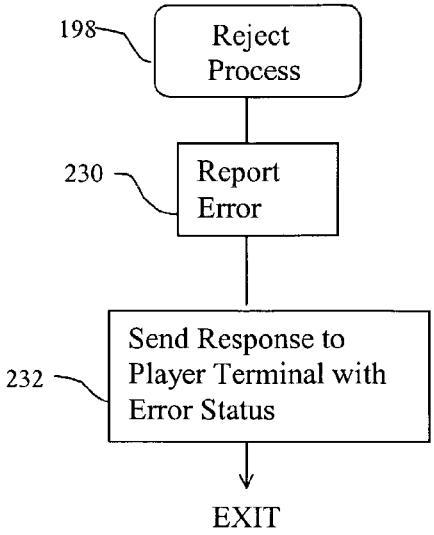
FIG. 15 is substantially a flowchart showing a reject process.

Referring now to FIG. 15, reject process 198 is shown. When reject process 198 is triggered during redemption process 190 (FIGS. 13 and 14), gaming system 20 reports an error at step 230. At step 232, the error report is sent to player terminal 26 where the voucher was inserted. Player terminal 26 may read the error report during player terminal voucher acceptance process 164 (FIG. 12), which may cause player terminal 26 to go into a timeout mode, or a disabled mode, and reject the voucher.

Figure 16:
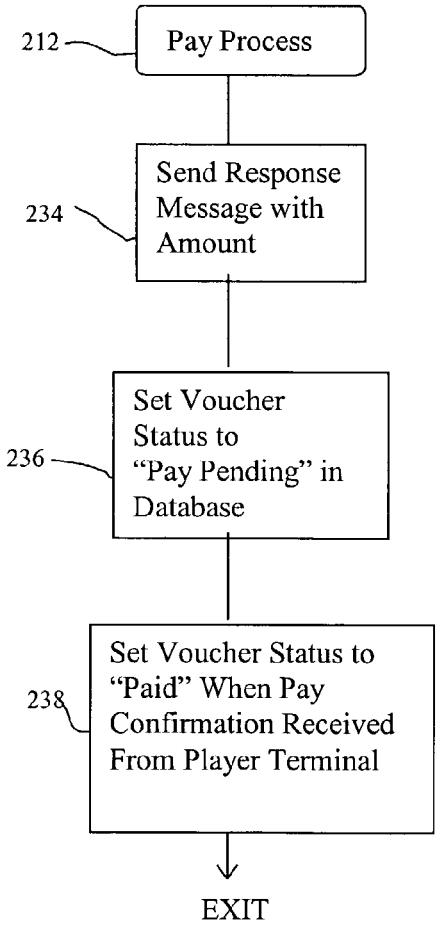
FIG. 16 is substantially a flowchart showing a pay process.

Referring now to FIG. 16, pay process 212 is shown. When pay process 212 is triggered during redemption process 190 (FIGS. 13 and 14), gaming system 20 sends a response message to player terminal 26 at step 234, which may include a credit amount, depending on the voucher type. (See also step 180, FIG. 12). At step 236, gaming system 20 sets the voucher status in database server 22 as "pay pending." At step 238, when player terminal 26 has paid the voucher and has sent a confirmation regarding the payment to gaming system 20, gaming system 20 sets the voucher status in database server 22 as "paid."

Figure 17:
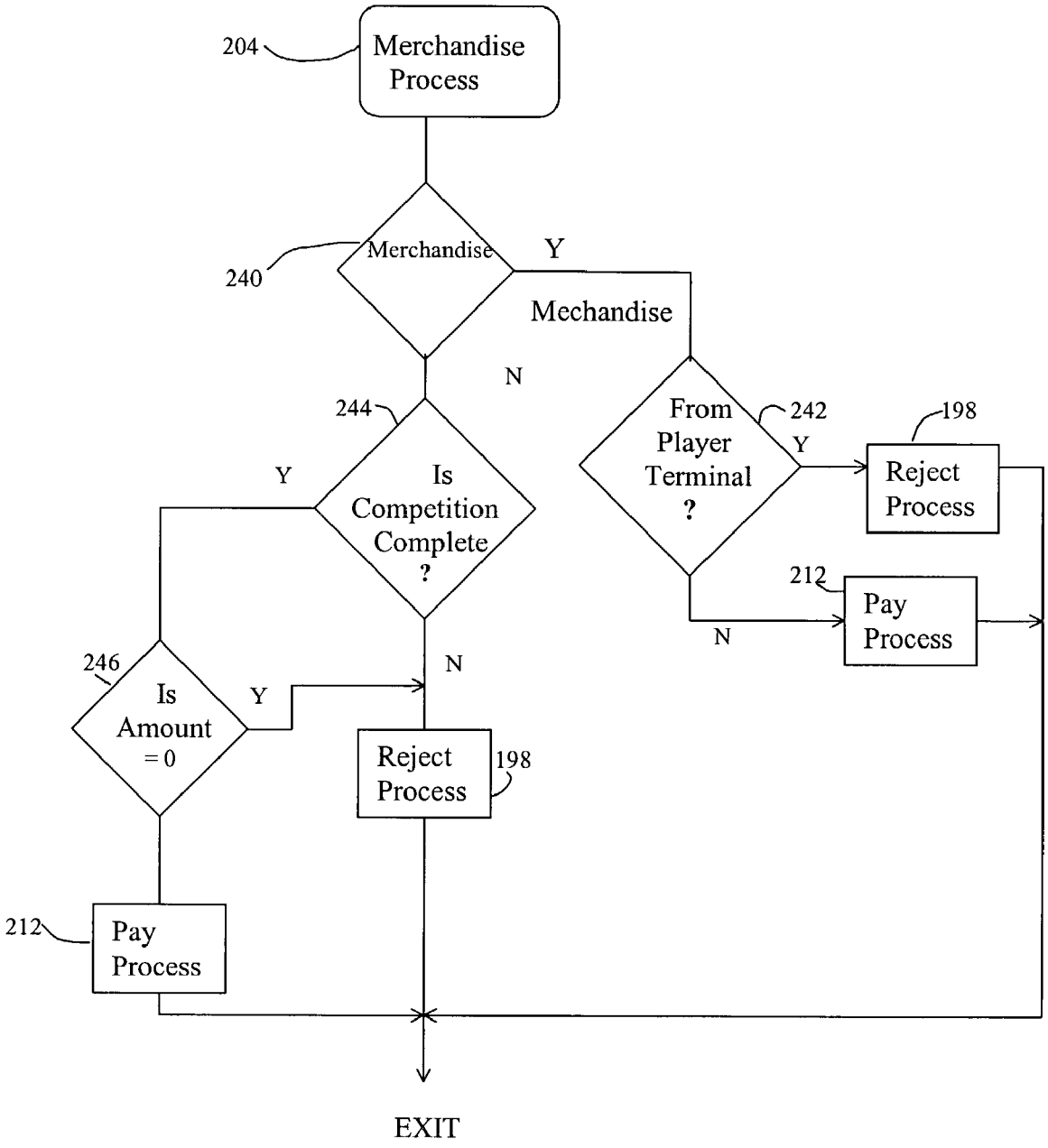
FIG. 17 is substantially a flowchart showing a gaming system process for allowing players to redeem a merchandise voucher and a competition entry voucher.

Referring now to FIG. 17, merchandise process 204 is shown. Merchandise process 204 is triggered during redemption process 190 (FIG. 13) when the voucher type is either a merchandise voucher or a competition entry voucher. At step 240, voucher reader 38 determines whether the inserted voucher is a merchandise voucher type. If the voucher is a merchandise voucher type, then CPU 48 queries whether the merchandise voucher was introduced from a player terminal 26. Merchandise vouchers are preferably unusable to play a game of chance on player terminals 26. Merchandise vouchers are preferably usable to redeem merchandise, such as jewelry, a car key, or a dinner. Thus, if CPU 48 detects that a merchandise voucher was introduced at player terminal 26, reject process 198 (explained above) is triggered. On the other hand, if CPU 28 detects that a merchandise voucher was not introduced at a player terminal 26, or that a merchandise voucher was introduced at a cashier terminal 28, then pay process 212 (explained above) is triggered.

Referring back to step 240, if voucher reader 38 determines that the voucher type is not a merchandise voucher, then the voucher type must be a competition entry voucher. Thus, CPU 48 determines whether there are any on-going competitions at step 244. If there are any on-going competitions, then CPU 48 executes reject process 198. If there are no on-going competitions, then CPU 48 determines whether the competition entry voucher has any value left. If the voucher has no value (value=0) at step 246, then CPU 48 executes reject process 198. If the voucher has some value, then CPU 48 executes pay process 212. It is noted that the flowchart in FIGS. 12-17 only shows one possible embodiment. Some of the steps in the flowchart may be varied, changed in order, or eliminated and still fall within the scope of the present invention.

Figure 18:
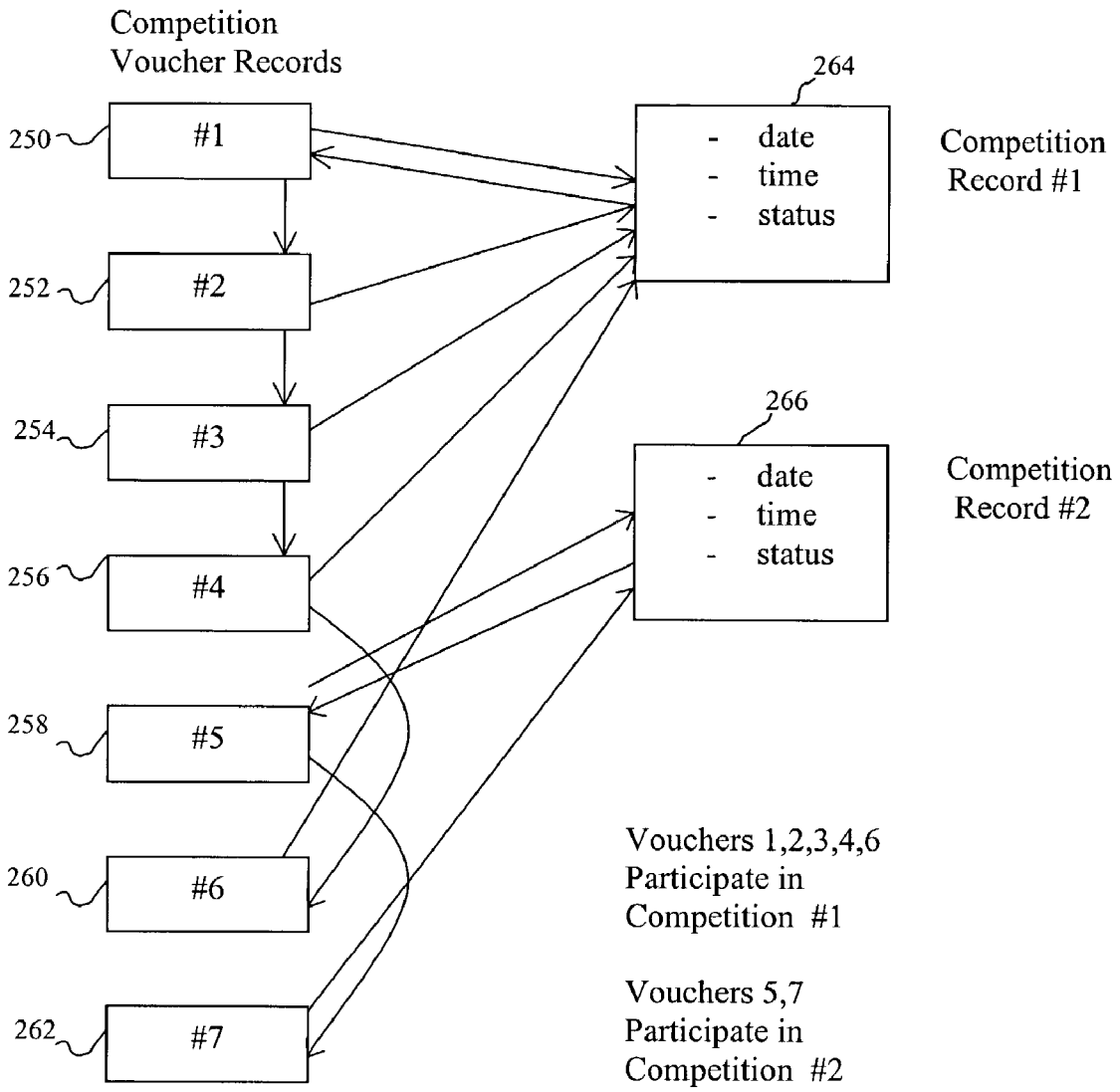
FIG. 18 is substantially a flowchart showing a handling process for competition entry vouchers.

Referring now to FIG. 18, FIG. 18 shows a schematic diagram of how gaming system 20 handles multiple competition entry vouchers 65 and how gaming system 20 determines whether each competition entry voucher 65 is eligible to participate in a particular tournament or competition. Database server 22 or CPU 48 preferably stores records of competitions 264 and 266 including such information as the date of the competition, the time of the competition, and the status of each competition (i.e. whether each competition is ongoing, has been completed, or is yet to be conducted.) When vouchers 250, 252, 254, 256, 258, 260, and 262 are presented to gaming system 20, each voucher preferably can be linked to a corresponding competition record. For example, vouchers 250, 252, 254, 256, and 260 match the date, time, and status of competition record 264. Thus, vouchers 250, 252, 254, 256, and 260 may be used to allow their respective voucher holders to participate in the competition pertaining to competition record 264. Vouchers 258 and 262 match the date, time, and status of competition record 266. Thus, vouchers 258 and 262 may be used to allow their respective voucher holders to participate in the competition pertaining to competition record 266.

CONCLUSION

The present invention solves many of the problems associated with the prior art. Certain embodiments of the present invention provide a gaming system and method that reduce the inconveniences involved in cash-based wagering transactions. Certain embodiments have the ability to ascertain authenticity of each voucher being introduced into the gaming system and provide the ability to maintain records of each voucher being issued by the gaming system. Certain embodiments provide a convenient method of awarding jackpot prizes. Certain embodiments provide a convenient method of awarding jackpot prizes while at the same time ensuring that operator desired procedures are implemented prior to awarding jackpots. Certain embodiments provide vouchers that introduce players to competitions, allow players to test various games, allow players to test various games while at the same time allowing players to win without direct out of pocket expense, and promote casino games, services, merchandise, and events using vouchers. Certain embodiments further have the ability to encourage players to continue playing games of chance.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A method of gaming comprising:

allowing a player to place a wager;

allowing the player to play a game of chance with a player terminal;

providing a plurality of prizes for the game of chance;

providing a special award for the game of chance, the special award being based on a randomly determined outcome;

producing the randomly determined outcome that entitles the player to the special award; and providing the player with a voucher, the voucher being usable to redeem the special award;

wherein the step of providing the special award comprises: determining if the player terminal is local or remote;

if the player terminal is local, providing the special award by referring to a prize table in the player terminal;

if the player terminal is remote, providing the special award by:

sending a request from the player terminal to a gaming system through a communications network, at the gaming system, providing the special award by referring to a prize table in the gaming system, and sending a message from the gaming system to the player terminal specifying the special award.

2. The method of claim 1 wherein the special award is at least one of: (a) a merchandise voucher; (b) a competition entry voucher, (c) a restricted play voucher, (d) a machine play voucher and (e) a mystery voucher.

3. The method of claim 1 further comprising requiring the player to redeem the jackpot prize by presenting the voucher at a cashier terminal.

4. The method of claim 3 further comprising requiring an attendant to execute a procedure associated with the entitlement of the jackpot prize before awarding the jackpot prize.

5. The method of claim 4 wherein the procedure comprises providing the player with a government form associated with the entitlement of the jackpot prize.

6. The method of claim 4 further comprising disabling the player terminal after producing the randomly determined outcome that entitles the player to the jackpot prize.

7. The method of claim 1 further comprising providing the player with a government form associated with the jackpot prize upon redemption of the jackpot prize.

8. The method of claim 7, further comprising:

presenting the voucher to redeem the jackpot prize;

determining authenticity of the voucher; and enabling the player terminal after determining the authenticity of the voucher.

* * * * *